US010724715B1

(12) United States Patent
Xu

(10) Patent No.: US 10,724,715 B1
(45) Date of Patent: Jul. 28, 2020

(54) GROUND-PLUG LED LAMP HOLDER

(71) Applicant: Xiaojun Xu, Jiangmen (CN)

(72) Inventor: Xiaojun Xu, Jiangmen (CN)

( * ) Notice: Subject to any disclaimer, the term of this patent is extended or adjusted under 35 U.S.C. 154(b) by 0 days.

(21) Appl. No.: 16/532,466

(22) Filed: Aug. 5, 2019

(30) Foreign Application Priority Data

Jul. 9, 2019 (CN) ..... 2019 1 0616213

(51) Int. Cl.

| | |
|---|---|
| ***F21V 21/08*** | (2006.01) |
| ***F21V 31/03*** | (2006.01) |
| ***F21V 23/00*** | (2015.01) |
| ***F21S 8/08*** | (2006.01) |
| ***F21V 23/06*** | (2006.01) |
| ***H01R 33/05*** | (2006.01) |
| ***F21Y 115/10*** | (2016.01) |
| ***F21W 131/10*** | (2006.01) |

(52) U.S. Cl.
CPC ..... *F21V 21/0824* (2013.01); *F21S 8/081* (2013.01); *F21V 23/001* (2013.01); *F21V 23/06* (2013.01); *F21V 31/03* (2013.01); *F21W 2131/10* (2013.01); *F21Y 2115/10* (2016.08); *H01R 33/05* (2013.01)

(58) Field of Classification Search
CPC .... F21V 21/0824; F21V 23/001; F21V 23/06; F21S 8/081
See application file for complete search history.

(56) References Cited

U.S. PATENT DOCUMENTS

| | | | | | |
|---|---|---|---|---|---|
| 5,367,442 | A * | 11/1994 | Frost | F21S 8/081 | 136/291 |
| 5,964,613 | A * | 10/1999 | Huang | F21S 8/081 | 439/417 |
| 6,082,877 | A * | 7/2000 | Hughes | F21S 6/005 | 362/152 |
| 6,093,051 | A * | 7/2000 | O'Brien | F21S 8/081 | 439/419 |
| 6,135,623 | A * | 10/2000 | Lin | F21S 8/081 | 362/353 |
| 2006/0262522 | A1* | 11/2006 | Allsop | F21S 8/081 | 362/153.1 |
| 2009/0122564 | A1* | 5/2009 | Beadle | F21S 8/081 | 362/431 |
| 2019/0101265 | A1* | 4/2019 | Steele | F21V 13/10 | |
| 2019/0338902 | A1* | 11/2019 | Zinsky | F21S 9/035 | |

* cited by examiner

*Primary Examiner* — William N Harris

(57) ABSTRACT

A ground-plug LED lamp holder is provided, including a socket, a ground-plug portion, and at least one tube portion insertedly connected between the socket and the ground-plug portion, wherein the socket includes a core shaft configured to insertedly connect to a lamp, a mounting opening configured to mount a lamp cover to the socket, and a drainage hole configured to discharge liquid inside the socket via the tube portion. By means of the design according to the present disclosure, the lamp holder can be stably installed outdoors for use and has a quick adjustment of installation height, a reasonable distribution of wires and a drainage function, which meets a requirement for using outdoors.

10 Claims, 7 Drawing Sheets

GROUND-PLUG LED LAMP HOLDER

CROSS-REFERENCE TO RELATED APPLICATIONS

This application claims priority to Chinese Patent Application No. 201910616213.X, filed Jul. 9, 2019, which is hereby incorporated by reference herein as if set forth in its entirety.

TECHNICAL FIELD

The present disclosure relates to a field of lamp appliance, more particularly to a ground-plug LED lamp holder.

BACKGROUND

A lamp appliance is an appliance that transmits and distributes light, and changes the light distribution of the light source, including, except light source, all parts and components required to secure and protect the light source, and wiring accessories necessary to connect with the power source. The lamp appliance, as a kind of luminaire, enables a light source to reliably emit light in order to meet demands for light of people engaged in various activities. An electrical lamp appliance includes an optical component, an electrical component and a mechanical component in addition to an electric light source. Most of lamp holders need to be fixed by mechanical structures such as screws, and can not be stably installed outdoors for use, and hardly have a quick adjustment of installation height and a jumbled distribution of wires, and have no drainage function.

SUMMARY

A ground-plug LED lamp holder is provided according the present disclosure for solving the aforementioned problems, so that the lamp holder can be stably installed outdoors for use and has a quick adjustment of installation height, a reasonable distribution of wires and a drainage function, which meets a requirement for using outdoors.

The present disclosure is realized by the following technical solutions.

A ground-plug LED lamp holder is provided according to the present disclosure, including a socket, a ground-plug portion, and at least one tube portion insertedly connected between the socket and the ground-plug portion, wherein the socket includes a core shaft configured to insertedly connect to a lamp, a mounting opening configured to mount a lamp cover to the socket, and a drainage hole configured to discharge liquid inside the socket via the tube portion.

In some embodiments, the tube portion has at least one wiring groove arranged on an outer periphery of the tube portion and extending in an axial direction of the tube portion.

In some embodiments, the socket further includes a first housing and a second housing, each of the first housing and the second housing having a semicircular tubular structure and being integrally molded.

In some embodiments, the first housing is provided with a positioning strip, and the second housing is provided with a positioning slot, the positioning strip being inserted into the positioning slot when the first housing and the second housing are assembled.

In some embodiments, the first housing defines an inner cavity provided with a first partition plate and a second partition plate, the first partition plate being provided with a first recess and a second recess, each of the first recess and the second recess having a semicircular shape, the second partition plate having a second recess and a third recess, each of the second recess and the third recess has a semicircular shape, and two connecting posts are located between the second partition plate and the first partition plate.

In some embodiments, the second housing defined an inner cavity provided with a first partition plate and a second partition plate, the first partition plate being provided with a first recess and a second recess, each of the first recess and the second recess having a semicircular shape, the second partition plate having a second recess and a third recess, each of the second recess and the third recess having a semicircular shape, and two mounting tubes being located between the second partition plate and the first partition plate.

In some embodiments, two oppositely disposed second recesses are engaged to form the drainage hole and two oppositely disposed third recesses are engaged to form a wire holding hole when the first housing and the second housing are assembled.

In some embodiments, the ground-plug LED lamp holder further includes a wire holding portion protruding radially inward from an inner wall of the wire holding hole.

In some embodiments, the tube portion includes a body, and a plug joint protruding from an end portion of the body and fixedly connected to the body, each of the body and the socket being provided with a plug hole matched with the plug joint.

In some embodiments, the ground-plug portion has one end portion provided with a plug joint and one other end portion provided with a tip.

The present application has the following advantages:

A ground-plug LED lamp holder is provided according to the present disclosure, including a socket, a ground-plug portion, and at least one tube portion insertedly connected between the socket and the ground-plug portion, wherein the socket includes a core shaft configured to insertedly connect to a lamp, a mounting opening configured to mount a lamp cover to the socket, and a drainage hole configured to discharge liquid inside the socket via the tube portion. By means of the design according to the present disclosure, the lamp holder can be stably installed outdoors for use and has a quick adjustment of installation height, a reasonable distribution of wires and a drainage function, which meets a requirement for using outdoors.

DETAILED DESCRIPTION

The present disclosure will be further described below with reference to the accompanying drawings for more clearly and fully discussing the technical solutions of the present disclosure.

Figure 1:
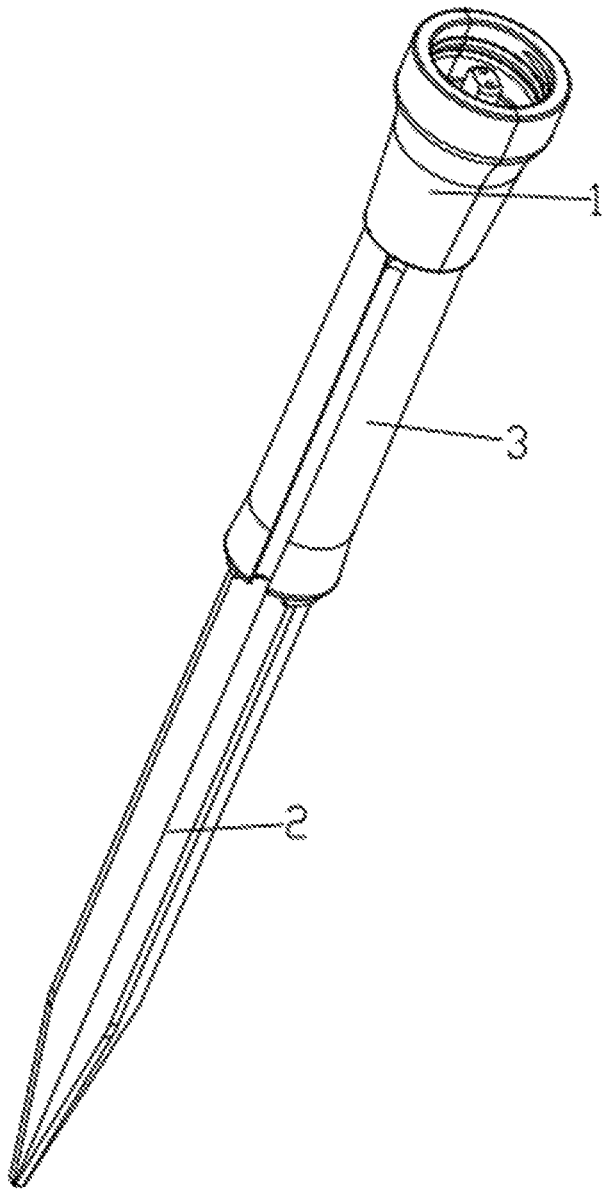
FIG. 1 schematically shows a structural view of a ground-plug LED lamp holder according to an embodiment of the present disclosure.
Figure 2:
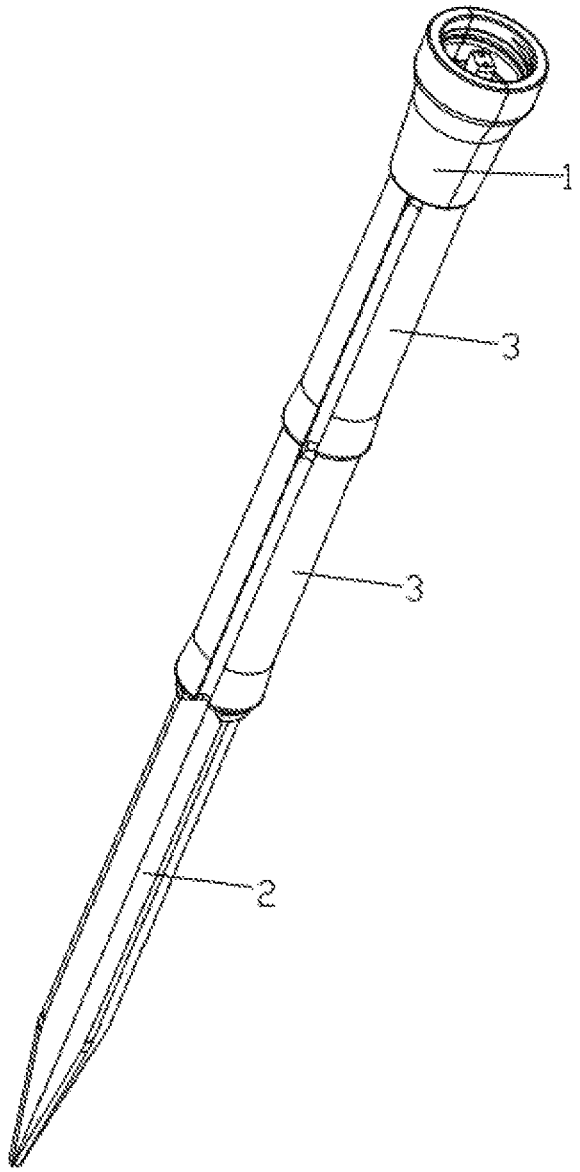
FIG. 2 schematically shows a structural view of a ground-plug LED lamp holder according to another embodiment of the present disclosure.
Figure 3:
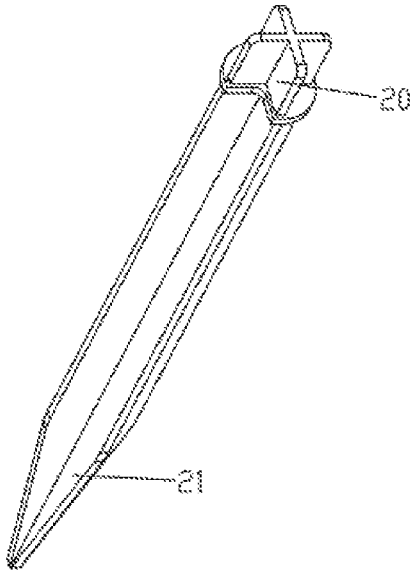
FIG. 3 schematically shows a structural view of a ground-plug portion of the ground-plug LED lamp holder according to the present disclosure.
Figure 4:
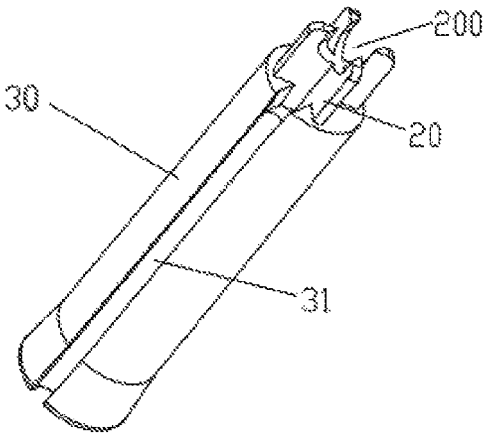
FIG. 4 schematically shows a structural view of a tube portion of the ground-plug LED lamp holder according to the present disclosure.
Figure 5:
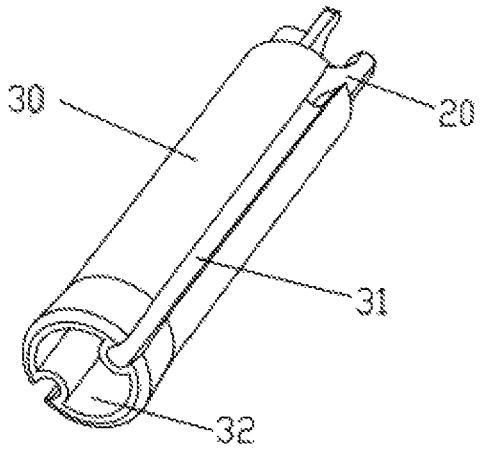
FIG. 5 schematically shows a structural view of the tube portion of the ground-plug LED lamp holder according to the present disclosure from another viewpoint.
Figure 6:
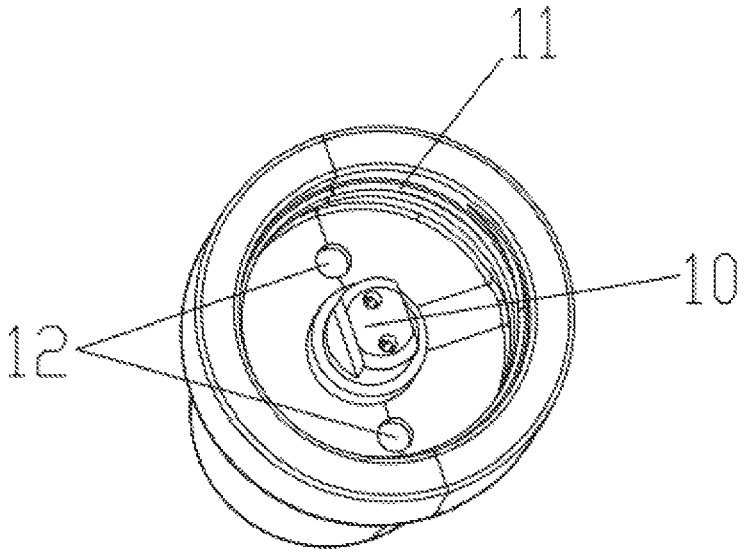
FIG. 6 schematically shows a structural view of a socket of the ground-plug LED lamp holder according to the present disclosure.
Figure 7:
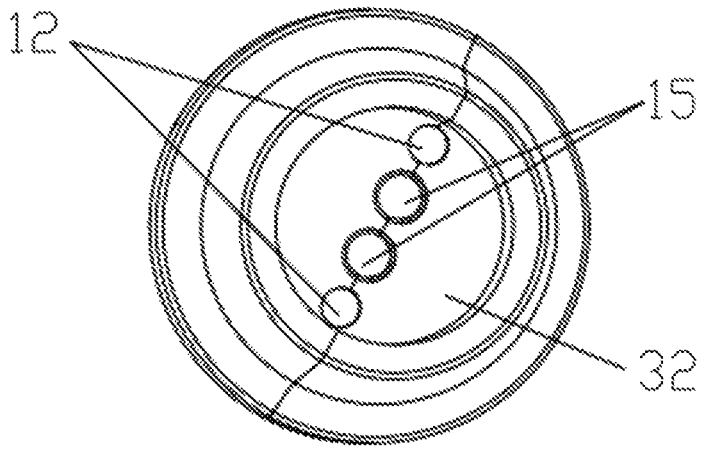
FIG. 7 schematically shows a structural view of the socket of the ground-plug LED lamp holder according to the present disclosure from another viewpoint.
Figure 8:
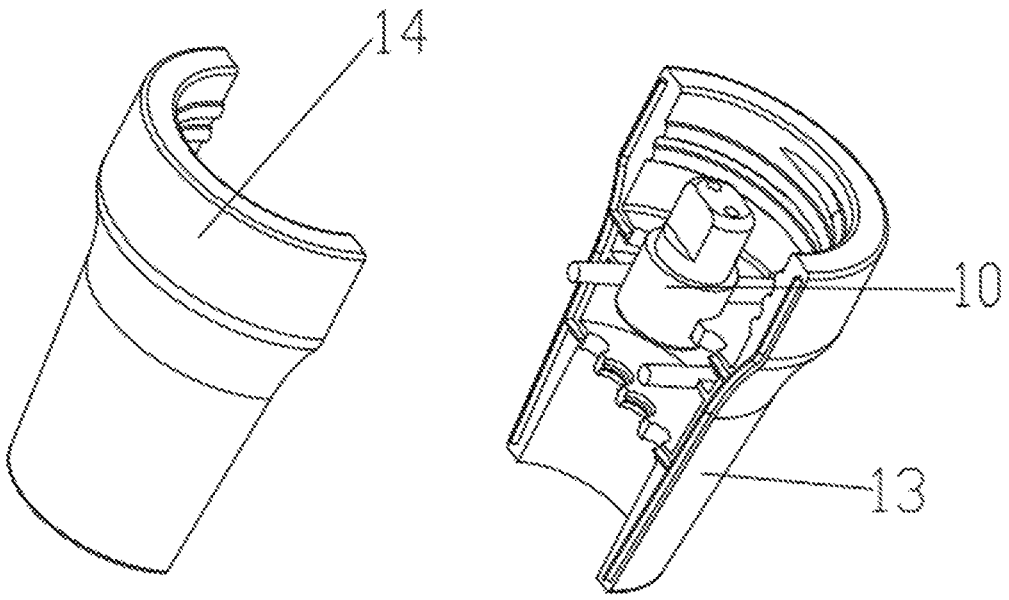
FIG. 8 schematically shows a exploded view of the socket of the ground-plug LED lamp holder according to the present disclosure.
Figure 9:
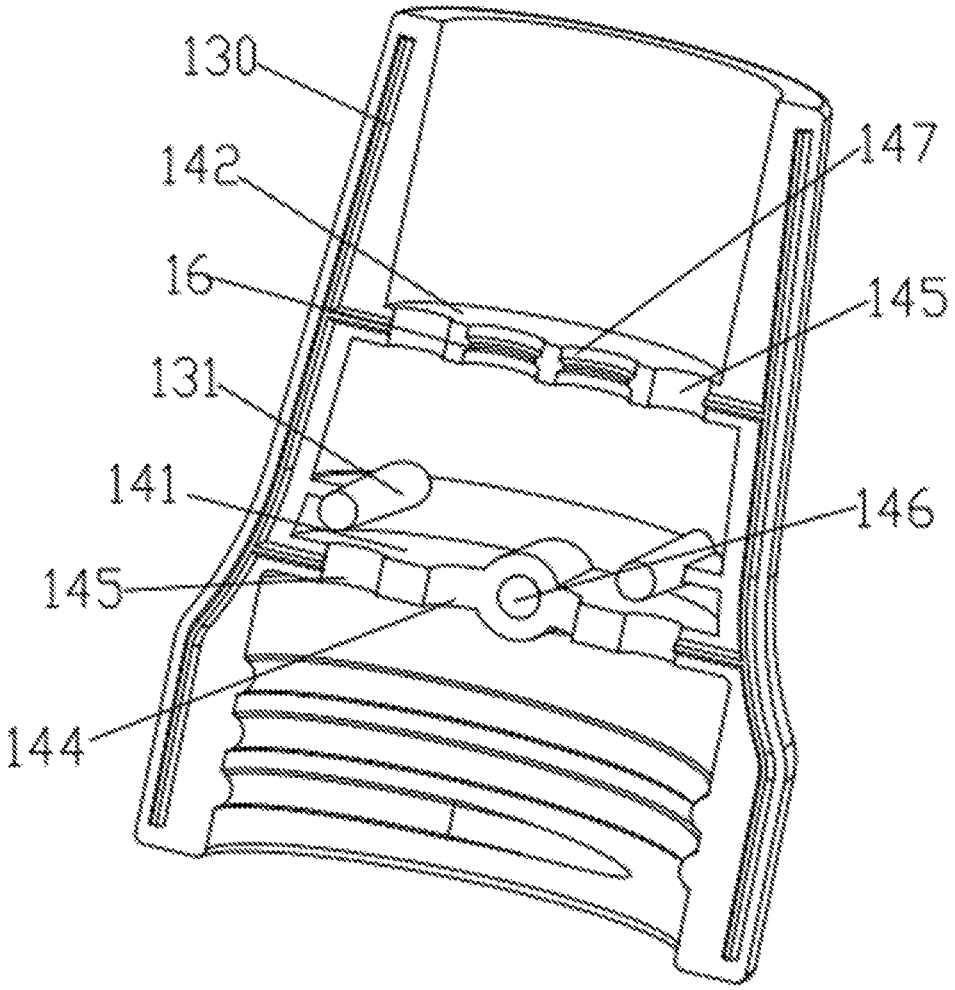
FIG. 9 schematically shows a structural view of a first housing of the ground-plug LED lamp holder according to the present disclosure.
Figure 10:
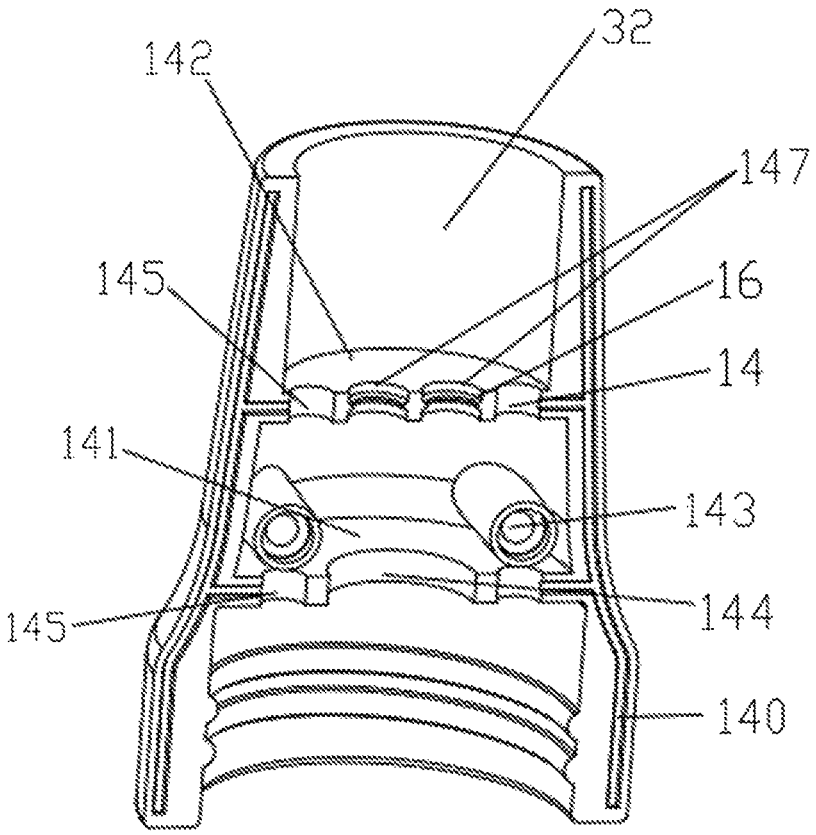
FIG. 10 schematically shows a structural view of a second housing of the ground-plug LED lamp holder according to the present disclosure.
Figure 11:
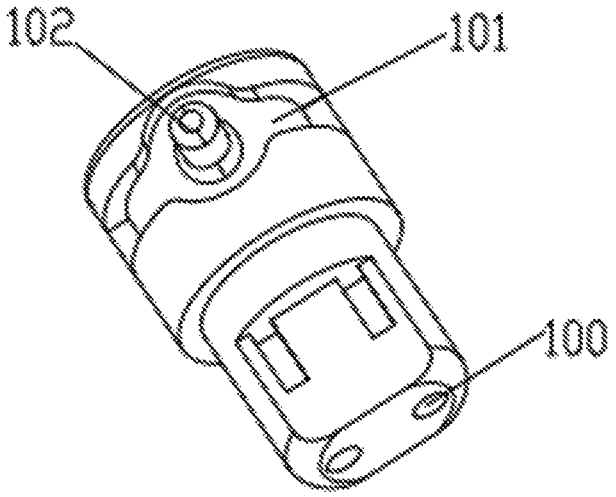
FIG. 11 schematically shows a structural view of a core shaft of the ground-plug LED lamp holder according to the present disclosure.

Referring to FIGS. 1-11, a ground-plug LED lamp holder is provided according to the present disclosure, including a socket 1, a ground-plug portion 2, and at least one tube portion 3 insertedly connected between the socket 1 and the ground-plug portion 2. The socket 1 includes a core shaft 10 configured to insertedly connect to a lamp, a mounting opening 11 configured to mount a lamp cover to the socket 1, and a drainage hole 12 configured to discharge liquid inside the socket 1 via the tube portion 3.

Further, the ground-plug portion 2 has one end portion provided with a plug joint 20 and one other end portion provided with a tip 21.

In the present embodiment, the ground-plug portion 2 is provided with the tip 21 so as to be inserted into a soft layer, such as garden soil or the like, so that the ground-plug LED lamp holder of the present disclosure is quickly and stably installed outdoors for use.

In the present embodiment, at least one tube portion 3 is insertedly connected between the socket 1 and the ground-plug portion 2. The number of the tube portions 3 is adjustable according to actual needs of the user. Inserted connection between the socket 1, the ground-plug portion 2 and the tube portion 3 can be performed manually, and an installation height of the lamp holder can be quickly adjusted without using a special tool.

Further, the tube portion 3 includes a body 30, and a plug joint 20 protruding from an end portion of the body 30 and fixedly connected to the body 30. Each of the body 30 and the socket 1 is provided with a plug hole 32 matched with the plug joint 20.

In the present embodiment, in order to ensure the inserted connection effect between the socket 1, the ground-plug portion 2 and the tube portion 3, the tube portion 3 is provided with the plug hole 32 and the plug joint 20 configured to be inserted into the plug hole 32. For enabling a stable inserted connection, the plug joint 20 has an outer diameter fit exactly with an inner diameter of the plug hole 32, that is, the plug joint 20 would not be loose when inserted into the plug hole 32.

In the present embodiment, since each tube portion 3 is provided with the plug hole 32 and the insertion joint 20, the tube portions 3 can be insertedly connected to each other, and the number of tube portions 3 is selected to adjust the installation height of the socket 1.

In the present embodiment, in order to achieve the inserted connection between the socket 1 and the tube portion 3, the socket 1 is provide with the plug hole 32 adapted to the plug joint 20. It should be appreciated that the plug hole 32 of the socket 1 has a cross-sectional shape that is not necessary to be the same as that of the plug hole 32 of the tube portion 3. The present disclosure is not intended to limit the cross-sectional shape of the plug hole 32.

In the present embodiment, in order to achieve the inserted connection between the tube portion 3 and the ground-plug portion 2, the plug joint 20 is provide at the end portion of the ground-plug portion 2. The plug joint 20 of the ground-plug portion 2 can be inserted into the plug hole 32 of the tube portion 3, and has a cruciform shape. It should be appreciated that the shape of the plug joint 20 of the ground-plug portion 2 is not necessary to be the same as the shape of the plug joint 20 of the tube portion 3. Likewise, the present disclosure is not intended to limit the shape of the plug joint 20.

In the present embodiment, the mounting opening 11 is provided with a screw thread configured to fix the lamp cover to the mounting opening 11 by screwing.

In the present embodiment, since the lamp holder is used outdoors, when a small amount of rainwater enter the socket 1, the rainwater passes through the drainage hole 12 and is discharged through the tube portion 3, which avoids a problem that the lamp and the core shaft 10 in the socket 1 fail to operate due to staying and squeezing of the rainwater in the socket 1, and thus enables the lamp holder to drain off water.

In the present embodiment, the core shaft 10 is configured to fix a power transmission wire. The core shaft 10 is provided with a jack 100 configured to electrically connected with the power transmission wire. The lamp is provided with a plug terminal matched with the jack 100, by which the lamp is removably plugged onto the core shaft 10.

Further, the socket 1 further includes a first housing 13 and a second housing 14, each of which has a semicircular tubular structure and is integrally molded.

In the present embodiment, sealing is performed between an outer wall of the first housing 13 and an outer wall of the second housing 14 by ultrasonic. Each of the first housing 13 and the second housing 14 is integrally formed to improve efficiency of assembly and manufacture.

Further, the first housing 13 is provided with a positioning strip 130, and the second housing 14 is provided with a positioning slot 140. The positioning strip 130 is inserted into the positioning slot 140 when the first housing 13 and the second housing 14 are assembled.

In the present embodiment, the positioning strip 130 includes two branches, one of which extends along a longitudinal direction of the first housing 13, the other one of which is cross with the branch extending along the longitudinal direction of the first housing 13 and extends in a direction towards the drainage hole 12. The positioning slot 140 and the positioning strip 130 are matched with each other. By such a design that the positioning strip 130 is configured to inserted into the positioning slot 140, it is achieved that the first housing 13 and the second housing 14 can be positioned and assembled to each other quickly and accurately.

Further, the first housing 13 defines an inner cavity provided with a first partition plate 141 and a second partition plate 142. The first partition plate 141 is provided with a first recess 144 and a second recess 145, each of which has a semicircular shape. The second partition plate 142 has a second recess 145 and a third recess 147, each of which has a semicircular shape. Two connecting posts 131 are located between the second partition plate 142 and the first partition plate 141.

Further, the second housing 14 defines an inner cavity provided with a first partition plate 141 and a second partition plate 142. The first partition plate 141 is provided with a first recess 144 and a second recess 145, each of which has a semicircular shape. The second partition plate 142 has a second recess 145 and a third recess 147, each of which has a semicircular shape. Two mounting tubes 143 are located between the second partition plate 142 and the first partition plate 141. Each of the mounting tubes is provided with an end opening.

Further, when the first housing 13 and the second housing 14 are assembled, two oppositely disposed second recesses 145 are engaged to form the drainage hole 12, two oppositely disposed third recesses 147 are engaged to form a wire holding hole 15, and meanwhile the connecting posts 131 are inserted into the mounting tubes 143.

In the present embodiment, each of the first partition plate 141 and the second partition plate 142 is provided with the drainage hole 12. Preferably, the first partition plate 141 is provided with two drain holes 12. Preferably, the second partition plate 142 is provided with two drain holes 12. Preferably, the second partition plate 142 is provided with two wire holding holes 15.

In the present embodiment, the first recess 144 of the first partition plate 141 and the first recess 144 of the second partition plate 142 together surround an outer periphery of the core shaft 10, being configured to fix the core shaft 10. In order to increase the stability of the fixing, the core shaft 10 is provided with a shaft-side groove 101 into which the first recess 144 of the first partition plate 141 and the first recess 144 of the second partition plate 142 are snapped. The core shaft 10 is further provided with a positioning post 102. The first recess 144 of the first partition plate 141 is further provided with a notch 146 into which the positioning post 102 is inserted.

Further, the tube portion 3 has at least one wiring groove 31 arranged on an outer periphery of the tube portion 3 and extending in an axial direction of the tube portion 3.

In the present embodiment, two wiring grooves are provided 31. When two tube portions 3 are insertedly connected with each other, the wiring grooves 31 of the two tube portions 3 are exactly aligned and abutted with each other.

In the present embodiment, the power transmission wire has one end fixedly and electrically connected to the core shaft 10, and one other end passing through the wire holding hole 15 to exit the socket 1 and then being mounted in the wiring groove 31 to extend along the wiring groove 31. In this way, a reasonable distribution of the power transmission wire electrically connected to the lamp holder is achieved, which avoids the exposed the power transmission wire being jumbled, prevents children from being tripped, and results in an fine appearance of the lamp holder.

In the present embodiment, in order to prevent the plug joint 20 of the tube portion 3 from plugging the drainage hole 12 and the wire holding hole 15 when the plug joint 20 is inserted into the plug hole of the socket 1, the plug joint 20 of the tube portion 3 is designed to have a cruciform shape in a cross-section thereof. The plug joint 20 of the tube portion 3 has one end defining a cavity structure 200 which includes a smoothly transited inner wall to avoid cutting and damaging the power transmission wire.

Further, a wire holding portion 16 is provided and protrudes radially inward from an inner wall of the wire holding hole 15.

In the present embodiment, the wire holding portion 16 has a circular ring shape and is configured to secure the power transmission wire. When the power transmission wire passes through the wire holding hole 15, the power transmission wire can be secured in the wire holding hole 15, such that wiggling of the power transmission wire of the socket 1 which influences stability of the electrical connection between the core shaft 10 of the socket 1 and power transmission wire is avoided.

It should be appreciated that the present disclosure may have other various embodiments. Modifications and variations made by those skilled in the art based on the embodiments according to the present disclosure without any creative work also fall within the scope of the present disclosure.

What is claimed is:

1. A ground-plug LED lamp holder, comprising a socket, a ground-plug portion, and at least one tube portion insertedly connected between the socket and the ground-plug portion, wherein the socket comprises a core shaft, a mounting opening and a drainage hole, and the drainage hole is configured to discharge liquid inside the socket via the tube portion, wherein the socket further comprises a first housing and a second housing, each of the first housing and the second housing having a semicircular tubular structure and being integrally molded, and wherein the first housing defines an inner cavity provided with a first partition plate and a second partition plate, the first partition plate being provided with a first recess and a second recess, each of the first recess and the second recess having a semicircular shape, the second partition plate having a second recess and a third recess, each of the second recess and the third recess has a semicircular shape, and two connecting posts are located between the second partition plate and the first partition plate.

2. The ground-plug LED lamp holder according to claim 1, wherein the tube portion has at least one wiring groove arranged on an outer periphery of the tube portion and extending in an axial direction of the tube portion.

3. The ground-plug LED lamp holder according to claim 1, wherein the first housing is provided with a positioning strip, and the second housing is provided with a positioning slot, the positioning strip being inserted into the positioning slot when the first housing and the second housing are assembled.

4. The ground-plug LED lamp holder according to claim 1, wherein the second housing defines an inner cavity provided with a first partition plate and a second partition plate, the first partition plate being provided with a first recess and a second recess, each of the first recess and the second recess having a semicircular shape, the second partition plate having a second recess and a third recess, each of the second recess and the third recess having a semicircular shape, and two mounting tubes being located between the second partition plate and the first partition plate.

5. The ground-plug LED lamp holder according to claim 4, wherein two oppositely disposed second recesses are engaged to form the drainage hole and two oppositely disposed third recesses are engaged to form a wire holding hole when the first housing and the second housing are assembled.

6. The ground-plug LED lamp holder according to claim 4, further comprising a wire holding portion protruding radially inward from an inner wall of the wire holding hole.

7. The ground-plug LED lamp holder according to claim 1, wherein the tube portion comprises a body, and a plug joint protruding from an end portion of the body and fixedly connected to the body, each of the body and the socket being provided with a plug hole matched with the plug joint.

8. The ground-plug LED lamp holder according to claim 1, wherein the ground-plug portion has one end portion provided with a plug joint and one other end portion provided with a tip.

9. A ground-plug LED lamp holder, comprising a socket, a ground-plug portion, and at least one tube portion insertedly connected between the socket and the ground-plug portion, the socket comprising:

a mounting opening;

a first partition plate arranged oppositely to the mounting opening and connected to an inner wall of the socket, the first partition plate extending perpendicularly to a longitudinal axis of the socket and defining a through hole extending through a thickness of the first partition plate;

a core shaft inserted into the through hole; and a first drainage hole defined on the first partition plate, the first drainage hole extending through the thickness of the first partition plate and being configured to discharge liquid inside the socket via the tube portion.

10. The ground-plug LED lamp holder according to claim 9, wherein the socket further comprises a second partition plate arranged oppositely to the first partition plate and connected to the inner wall of the socket, the second partition plate extends perpendicularly to the longitudinal axis of the socket and defines a second drainage hole, and the second drainage hole extends through a thickness of the second partition plate and is configured to discharge liquid inside the socket via the tube portion.

* * * * *